US005975378A

United States Patent [19]

Bayer

[11] Patent Number: 5,975,378

[45] Date of Patent: Nov. 2, 1999

[54] AEROSOL POWDER VALVE

[75] Inventor: Christian Bayer, Armonk, N.Y.

[73] Assignee: Precision Valve Corporation, Yonkers, N.Y.

[21] Appl. No.: 09/093,811

[22] Filed: Jun. 9, 1998

[51] Int. Cl.[6] ..... B65D 83/16

[52] U.S. Cl. ..... 222/402.24

[58] Field of Search ..... 222/402.1, 402.24

[56] References Cited

U.S. PATENT DOCUMENTS

| | | | |
|---|---|---|---|
| 3,160,182 | 12/1964 | Odonnell | 222/402.24 X |
| 3,174,692 | 3/1965 | Green | 222/402.24 X |
| 3,187,963 | 6/1965 | Anderson | 222/402.24 X |
| 3,773,064 | 11/1973 | Focht | 222/402.24 X |

*Primary Examiner*—Kenneth Bomberg
*Attorney, Agent, or Firm*—Kilgannon & Steidl

[57] ABSTRACT

An aerosol powder valve has a valve housing, a valve body with an upstanding valve stem, radial stem orifices, and an annular tight-fitting gasket with a central opening forming the sole seal for the stem orifices. The valve stem is straight-sided above and below the stem orifices and is characterized by the absence of a gasket-receiving groove encircling the stem. The valve body has a plurality of narrow splines spaced around its periphery, the top spline surfaces being of minimal area in relation to the area of the circumferential spaces between the tops of the splines. The spline top surfaces abut the gasket underside when the valve is closed, and the minimal top spline areas prevent powder build-up to adversely affect full sealing of the valve. Other lateral surfaces on the valve body near the gasket are eliminated to likewise avoid powder build-up thereon. The spline sides may diverge outwardly and downwardly from the spline top surfaces. The gasket sealing surface surrounding the valve stem has a lubricant, i.e., silicone, baked thereon. The stem orifices are positioned vertically over circumferential spaces between splines.

5 Claims, 5 Drawing Sheets

AEROSOL POWDER VALVE

FIELD OF THE INVENTION

The present invention relates to valves to dispense products from pressurized containers, and more particularly to aerosol valves for dispensing powders held in suspension in liquified propellants in such containers.

BACKGROUND OF THE INVENTION

In a conventional form of aerosol valve assembly, a vertically acting aerosol valve is opened to release product in the aerosol container by downwardly depressing a button or cap attached to the top of the upstanding stem of the aerosol valve. When the button is released, the valve is closed by a spring acting on the valve. The valve body positioned at the lower part of the valve stem has an upper horizontal continuous sealing surface circumferentially surrounding the valve stem. This upper horizontal surface, when the aerosol valve is closed, is urged upwardly into sealing relation against the valve sealing gasket by the spring acting on the valve body. One or more orifices in the valve stem are positioned above the lower surface of the valve gasket when the valve is in the closed position. The valve stem passes through a central opening in the gasket, and the circumferential surface of the central opening may provide a radially acting, secondary seal of the valve stem when the valve is closed. When the valve is opened by pressing the button, the valve stem moves downwardly and its one or more orifices will move to a position below the gasket. Product in the aerosol container may now, under the influence of propellant, pass upwardly through the conventional dip tube into the valve housing which surrounds the valve stem and valve body, then upwardly to flow over the upper horizontal surface of the valve body circumferentially surrounding the valve stem, through the one or more orifices into the valve stem, upwardly through the valve stem, and outwardly through an outlet nozzle in the button or cap attached to the top of the valve stem.

The above-described conventional aerosol valve is used to dispense many products including, in aspects particularly relevant to the present invention, products having powder suspended in a liquified propellant. Such products include antiperspirants, deodorants, foot sprays, etc. Unfortunately, the action of the conventional aerosol valve is compromised by powder build-up on the aforedescribed upper horizontal sealing surface of the valve body when the powder product is released from the aerosol container. This powder accumulation interferes with the full resealing action of the valve by causing the valve to be held partially open after the button is released. The result is that the aerosol container loses pressure even when not in use, and the propellant leakage can impair or destroy the usefulness of the pressurized container after a few operations of the valve. The problem is further exacerbated in the circumstance where modern day high powder loading is desired in the product to be dispensed, for example fifty-sixty percent solids by weight in the case of certain powder antiperspirants where the solids include the powder and other solids in the formulation.

Attempts have been made to overcome the above problems of powder valves, one such instance being disclosed in UK Patent Specification 1216655 wherein a plurality of concentric ribs with sharp top edges are placed on the aforesaid top horizontal sealing surface of the valve body (or on the lower gasket sealing surface) to encircle the valve stem. The sharp top edges cooperate with the gasket to form the valve sealing surfaces, and when powder product is released by actuating the valve, powder build-up is intended to occur inside of, outside of and in the valleys between the concentric ribs rather than at the tops of the ribs. However, powder can still accumulate sufficiently in the valleys to ultimately interfere with the valve sealing action.

A further attempt to overcome the above problems of powder valves is disclosed in U.S. Pat. No. 3,773,064, wherein a circumferential groove surrounds the valve stem with the orifices lying in a conical outwardly tapering section at the top of the groove and the sealing gasket fitting within the groove and around the conical section. A protruding cylindrical ridge in the groove presses into the gasket to enhance sealing. However, the compound surfaces including the bottom of the groove still present opportunities for powder build-up in the design, particularly under present day requirements for powder products having heavy loading of solids.

SUMMARY OF THE INVENTION

The present invention is intended to provide an aerosol powder valve that eliminates the problem of powder build-up interfering with the valve sealing action. The upper horizontal sealing surface of the aforedescribed valve body about the valve stem is eliminated in the present invention. Instead, the sealing of the valve is obtained solely in radial directions toward the valve stem by a tight-fitting gasket encircling the valve stem. The outer surface of the valve stem is a straight up and down cylindrical surface having for example two lateral entry orifices, the straight stem surface not including the common prior art gasket grooves. Thus in the present design, there are no horizontal sealing surfaces and no groove surfaces where powder can otherwise accumulate to affect the valve sealing function or clog the orifices.

The cylindrical vertical valve stem surface continues downwardly below the orifices in the present invention so that the lower valve body in effect is a continuation of the straight valve stem with the exception of a plurality of narrow vertically extending splines spaced about the circumference of the valve body and having large circumferential spaces between each adjacent pair of splines. Each of the plurality of splines tapers inwardly in circumferential direction as the spline nears its upward limit, and the top of each spline forms a minimal horizontal area. When the powder valve is closed, the top of each spline abuts against the sealing gasket to limit the upward return travel of the valve stem under the influence of the spring. However, the minimal horizontal top area of each spline results in a minimal individual and total horizontal surface at the top of the splines, thus preventing powder build up on horizontal surfaces to adversely affect the sealing of the valve.

The number of splines and their individual top surface horizontal areas will be selected such that the splines (a) will not pierce the sealing gasket to destroy its aforedescribed radial sealing of the orifices surrounded by the gasket, and (b) will have minimal top horizontal areas to prevent powder build-up on the tops of the splines. Obviously, a lesser rather than greater number of splines for a given spring force and gasket material will require a larger top area of each spline to prevent gasket piercing. In the embodiment hereafter described, eight equally-spaced splines surround the valve stem, each having a top surface area of approximately 0.000235 square inches directly abutting the vertical stem surface, the stem having an outer diameter of approximately 0.158 inches. Thus it will be seen that the spline top surface areas are kept very small in the present invention.

The large circumferential spacing between the splines in the present invention allows powder to fall back down between the splines and away from the gasket when the valve is closed, thus aiding in preventing any powder build-up on the gasket and orifices to interfere with sealing or clog the stem orifices. The orifices also are advantageously positioned circumferentially between a pair of splines rather than over an individual spline so as to remove the orifices from even the minimal top areas of the splines.

Below the top surfaces of the splines, the sides of each spline, as noted, taper outwardly away from each other over a small vertical distance, and then extend vertically toward the bottom of the valve body. Accordingly, each spline will have sufficient cross-sectional area over much of its vertical extent to allow handling of the valve body and stem during manufacture and valve assembly without breakage. Yet, by virtue of the taper, the minimal horizontal area for the top of each spline will be provided.

The sealing gasket for the valve has a central hole tightly fitting about the straight valve stem cylindrical surface so as to seal the stem orifices in radial directions as previously described. When the valve stem is depressed, the gasket remains flat rather than significantly deflecting downward (as it would if fitted within a stem-encircling groove), and when the valve stem is released, the gasket wipes away any accumulated powder from the valve stem. Any such accumulated powder will drop back down in the spaces between the splines. In order that the gasket hole will remain tight fitting about the stem for its sealing function, yet allow the stem to slide through the gasket on many progressive actuations of the valve, the cylindrical hole surface of the gasket may have a lubricant, for example silicone, baked thereon for continuing slidability.

The present invention accordingly will provide a powder valve that will operate through all of its successive cycles of operation without powder accumulation on horizontal surfaces to interfere with valve sealing, thereby resulting in insignificant leakage and optimum uses of propellant and product in the aerosol container.

Other features and advantages of the present invention will be apparent from the following description, drawings and claims.

DETAILED DESCRIPTION OF EMBODIMENT

Figure 1:
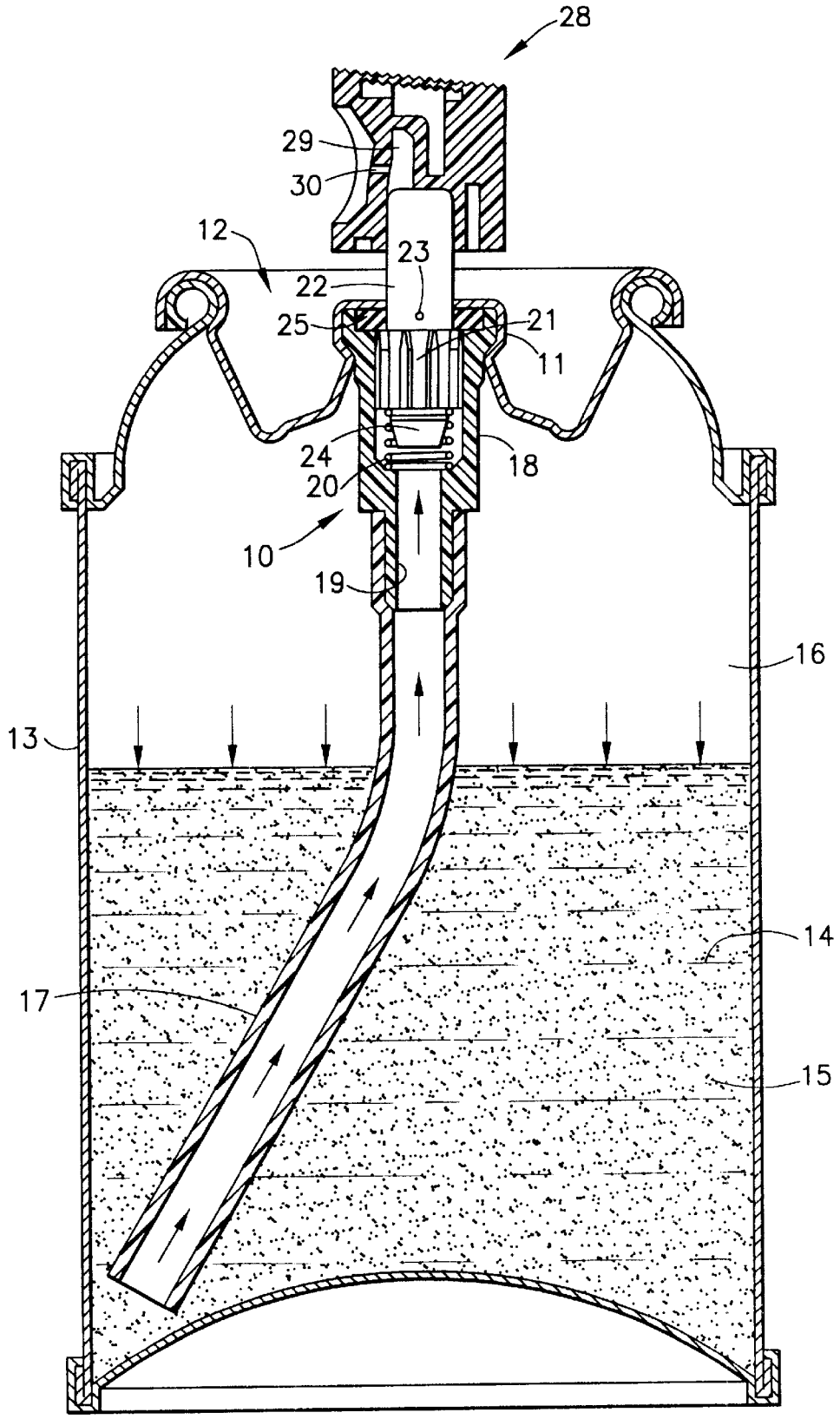
FIG. 1 is a side elevational view in partial section of an assembled powder valve of the present invention mounted within an aerosol container.
Figure 2:
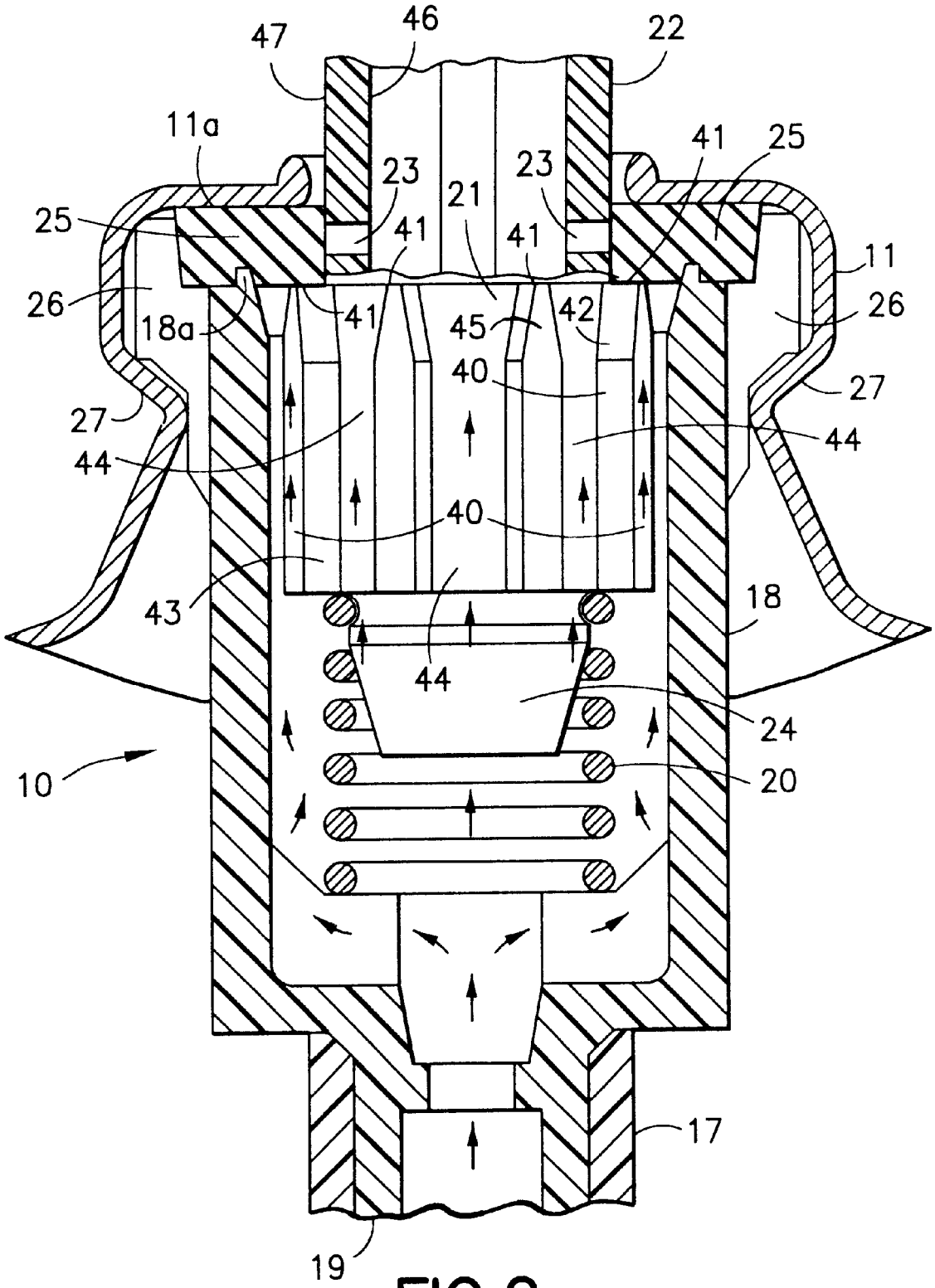
FIG. 2 is an enlarged side elevational view in partial section of an assembled powder valve of the present invention, the valve being in a closed position.
Figure 3:
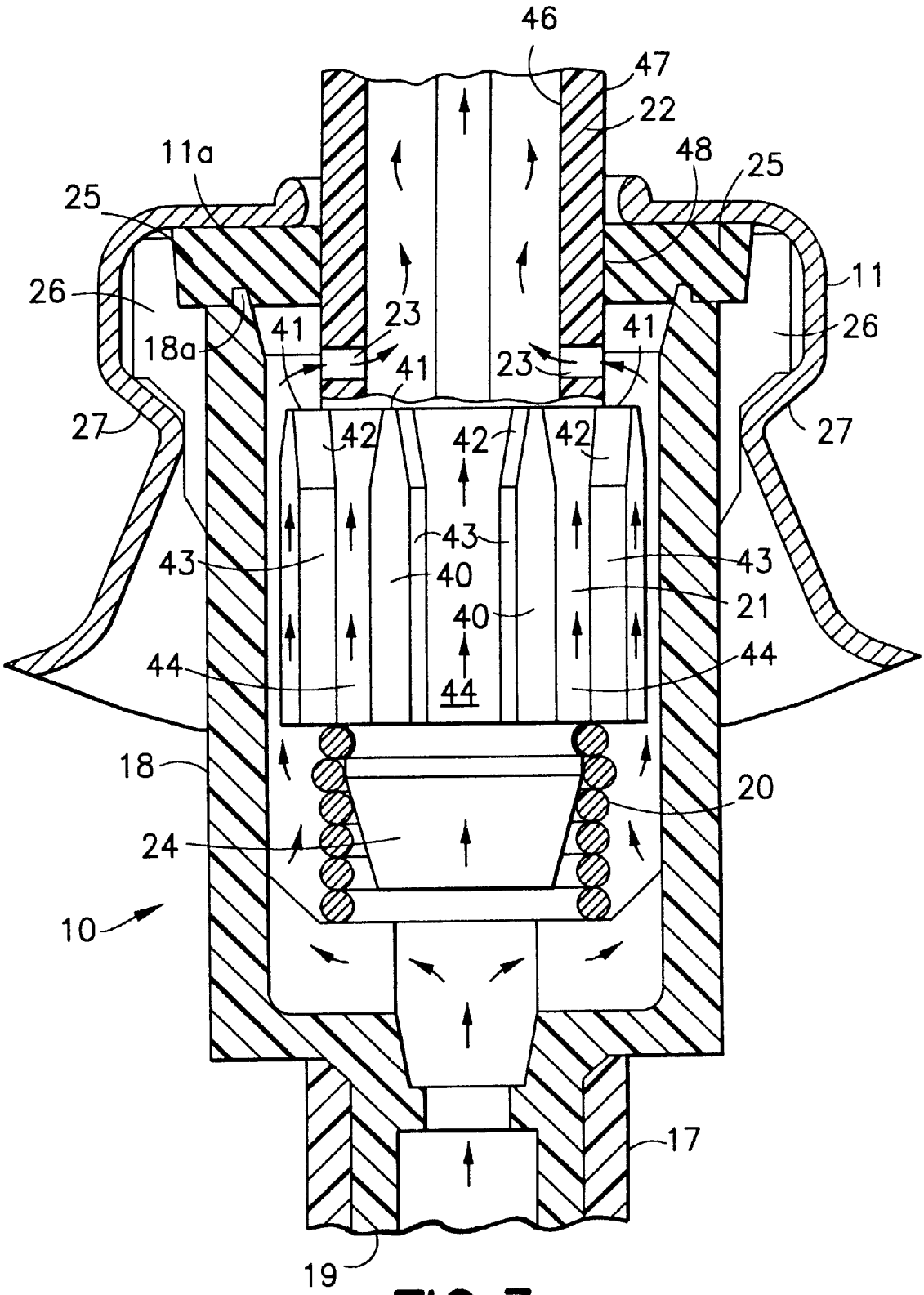
FIG. 3 is an enlarged side elevational view in partial section of an assembled powder valve of the present invention, the valve being in an open position.

Referring to FIGS. 1–3, an aerosol valve assembly, designated generally as 10, is fitted and crimped into a pedestal portion 11 of a mounting cup closure 12 for a pressurized container 13. Container 13 holds a liquified propellant 14 having a powder product 15 in suspension throughout, the gaseous propellant phase 16 overlying the liquified propellant.

Valve assembly 10 generally includes a dip tube 17, a valve housing 18, a dip tube receiving nipple 19 at the bottom of valve housing 18, valve closing coil spring 20, and valve body 21. The valve body 21 includes hollow valve stem 22 extending upwardly and containing two lateral orifices 23 entering from the outside of the stem into the interior of stem 22. Protrusion 24 extends downwardly from the valve body 21 and captures and centers the top of coil spring 20.

Resilient annular gasket 25 surrounds valve stem 22 and seals both the stem orifices 23 when the aerosol valve is closed (FIGS. 1 and 2). Annular gasket 25 is clamped between the underside 11*a* of pedestal portion 11 of the mounting cup 12 and the upper part 18*a* of valve housing 18. Valve housing 18 includes spacers 26 spaced about the periphery of the valve housing for pressurized filling of the container, all as more fully described in U.S. Pat. No. 4,015,757 (incorporated herein by reference) and forming no part of the present invention. The mounting cup is crimped at 27 around spacers 26 to retain the aerosol valve assembly 10.

Attached to the top of valve stem 22 by an annular channel is a conventional actuating button 28 having an internal product passage 29 in fluid contact with the hollow valve stem 22 and having outlet nozzle 30 for product ejection. When the button 28 is pressed downwardly against the force of spring 20, stem orifices 23 pass below annular gasket 25 (see FIG. 3) and the product within the aerosol container can now pass up dip tube 17, upwardly around valve body 21, through the stem orifices 23 into the valve stem 22, upwardly through the hollow stem into the actuating button 28, and outwardly through nozzle 30. When the button 28 is released, the spring 20 urges the valve stem 22 upwardly to the FIG. 2 position where the stem orifices 23 are now blocked by gasket 25. The valve is now closed and product flow is blocked from entering into the valve stem.

Figure 4:
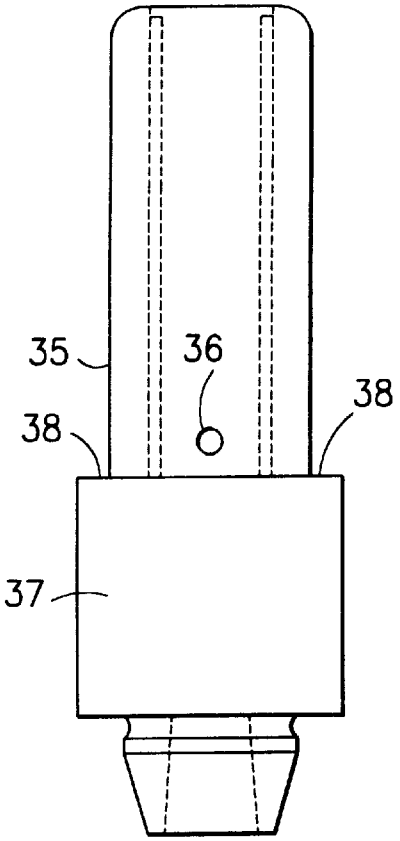
FIG. 4 is a side elevational view of the valve stem and valve body of a conventional prior art valve.

The above discussion in its generality applies to conventional aerosol valves, wherein it is common for the valve body below the stem orifices to be an essentially cylindrical member with greater diameter than the valve stem, thus having a continuous upper horizontal surface extending circumferentially around the valve stem. Such a conventional configuration is shown in FIG. 4, represented by valve stem 35, orifices 36 and cylindrical body member 37. Body member 37 has continuous upper horizontal surface 38 extending around valve stem 35, surface 38 conventionally abutting the underside of the sealing gasket (such as gasket 25 of FIG. 1) when the valve is closed to provide a continuous horizontal valve sealing surface around the stem. It is this horizontal surface 38 (and/or corresponding horizontal surfaces of the aforementioned stem grooves) that present the surfaces upon which powder product builds up on in successive valve operations to ultimately impair the valve sealing and create undesirable propellant leakage.

Figure 5:
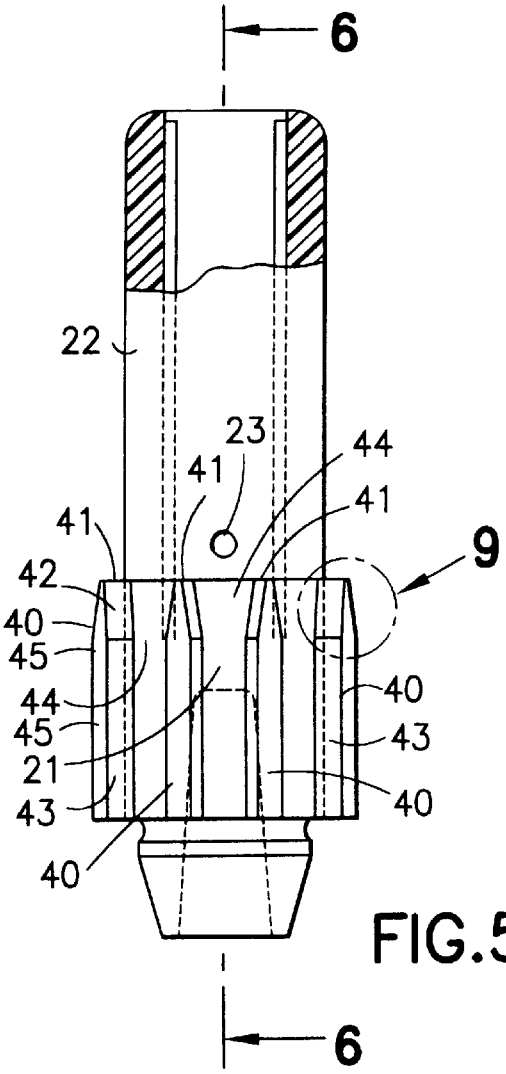
FIG. 5 is a side elevational view of the valve stem and valve body of the present invention.
Figure 7:
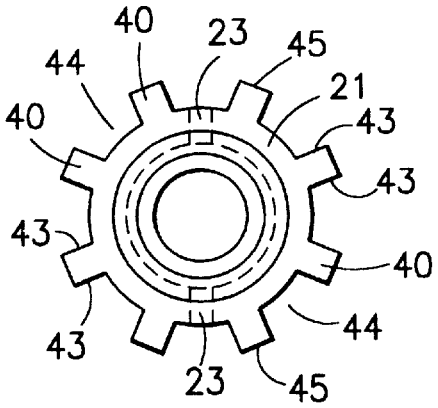
FIG. 7 is a bottom plan view of the valve stem and valve body of FIG. 5.
Figure 6:
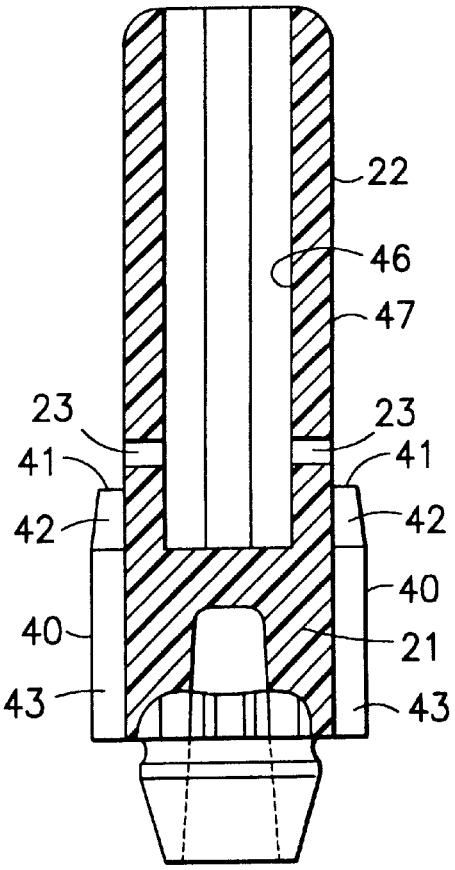
FIG. 6 is a partial cross-sectional view of the valve stem and valve body of the present invention taken along lines 6—6 of FIG. 5.
Figure 8:
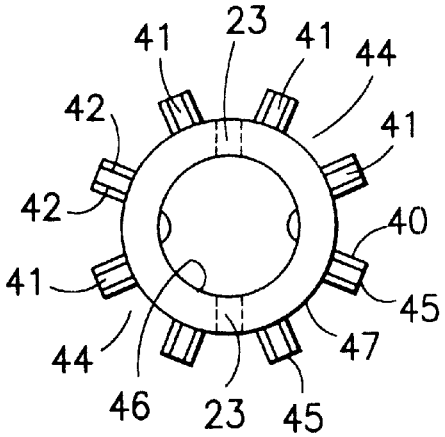
FIG. 8 is a top plan view of the valve stem and valve body of FIG. 5.
Figure 9:
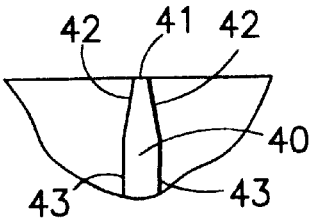
FIG. 9 is a fragmentary view taken from FIG. 5.

Now turning to the features of the present invention, the valve stem and valve body below the stem of FIG. 4 is to be contrasted with FIG. 5 (as well as FIGS. 2,3,6–9). The continuous top horizontal sealing surface 38 of FIG. 4 is eliminated, and the valve body 21 below the valve stem 22 is a vertical continuation of the valve stem 22 with the exception of eight narrow splines 40 equally spaced about the periphery of the valve body. Each spline 40 has a top surface 41 of minimal horizontal area. Tapered spline sides 42 diverge in circumferential directions from top surface 41 for a certain downward distance and then spline sides 43 extend vertically downward. Accordingly each spline 40 has sufficient structural integrity over most of its vertical extent to prevent damage in handling during valve manufacture and assembly operations, but at the same time each spline tapers at its top to provide the desired top surfaces 41 of minimal area. Large circumferential spaces 44 remain between each adjacent pair of splines 40. Stem orifices 23 are circumferentially displaced from the tops of adjacent splines so as to lie between a pair of adjacent splines.

Referring to FIG. 2, it will be seen that only the minimal top areas 41 of each spline 40 contact sealing gasket 25 when the valve is closed, thus providing no gasket sealing function but only the function of limiting the upward travel of valve stem 22 when the valve is closed. The arrows of FIG. 2 represent the powder product under upward pressure but unable to escape through stem orifices 23 because the valve is closed.

FIG. 3 illustrates the open valve condition whereby stem 22 has been depressed by the button and stem orifices 23 are now lowered below the gasket 25. Powder product can now escape from the container as indicated by the arrows shown in FIG. 3. The powder product flows upwardly within the valve housing 18 over the radially outer surfaces 45 of the splines 40 and in the circumferential spaces 44 between the splines 40. The powder product flow continues into the stem orifices 23, up the hollow valve stem 22, into the button 28, and out nozzle 30.

It will be noted from FIGS. 2,3,5, 8 and 9 that top surfaces 41 of the splines 40 are of minimal area so that there is no opportunity for any significant powder build-up on horizontal surfaces to interfere with the sealing of the valve. The top 41 of each spline 40 needs only to have a sufficient area so as not to pierce the sealing gasket 25 when the valve is closed. Likewise, stem orifices 23 pass straight through the sidewall of valve stem 22, the side wall being formed of concentric inner and outer walls 46 and 47, and there being no gasket-containing circumferential stem groove in the vicinity of the orifices as is common in prior art aerosol valves (for example, the previously-noted U.S. Pat. No. 3,773,064). Accordingly, the present invention has no significant non-vertical surfaces available for powder build-up in the vicinity of the valve sealing surfaces. Further, the large circumferential spaces 44 between the splines 40 permit powder to fall back downward through the spaces 44 when the valve is closed to the FIG. 2 position.

The valve stem, valve body and valve housing are molded of plastic, for example nylon. The gasket may be formed of rubber or neoprene of various formulations.

Figure 10:
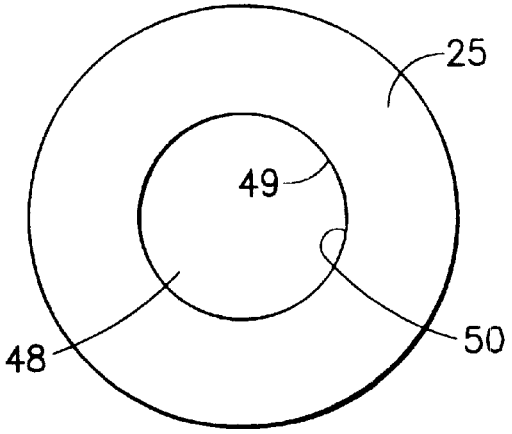
FIG. 10 is a plan view of the valve sealing gasket of the present invention.

Referring to FIG. 10, the valve sealing gasket 25 is illustrated having central opening 48. The gasket forms the only seal of the valve orifices 23, and is in tight-fitting relation about valve stem 22. It is essential that the valve stem be slidable through the gasket 25 through all the desired successive openings and closings of the valve, while still maintaining the sole tight-fitting sealing of the valve orifices 23 by the annular gasket 25 when the valve is closed in the FIG. 2 position. This is facilitated in the present invention by using a commercially available gasket (i.e., from American Gasket And Rubber Company) having a thin silicone coating 49 baked on the circumferential gasket surface 50 surrounding gasket central opening 48. The silicone coating provides a long-lasting slidable surface through the desired number of valve cycles, and the gasket 25 does not substantially deflect downwardly during valve openings to ultimately distort the tight-fitting gasket central opening radial dimension. The gasket 25 also serves to wipe any powder from the valve stem that may be present after a valve opening and closing, which powder then falls into the spaces 44 between splines 40.

In a sample embodiment of the present invention, the following nominal dimensions of the splines 40, gasket 25, and valve stem 22 have been used in an eight-spline configuration to provide a powder valve that provides fully adequate sealing and minimal leakage, as well as negligible powder build-up to interfere with the sealing and orifice flow after many successive valve cycles.

Valve stem (22) outer diameter—0.158 inches.

Valve stem (22) inner diameter—0.110 inches

Stem orifice (23) diameter—0.018 inches

Radial dimension spline top surface (41)—0.0235 inches

Width dimension spline top surface (41)—0.010 inches

Area of spline top surface (41)—0.000235 sq. inches

Vertical angle of spline tapered side (42)—10 degrees

Axial length of spline tapered side (42)—0.042 inches

Axial length of spline vertical side (43)—0.127 inches

Circumferential spline (40) dimension between spline vertical sides (43)—0.025 inches Axial distance stem orifice (23) center to spline top surface (41)—0.026 inches Gasket axial length—0.045 inches Gasket central opening diameter with silicone coating—0.120 inches It will be appreciated by persons skilled in the art that variations and/or modifications may be made to the present invention without departing from the spirit and scope of the invention. The present embodiment is, therefore, to be considered as illustrative and not restrictive. It should also be understood that such terms as "upper", "lower", "inner", "outer", "horizontal", "vertical", "top", "bottom", "above", "below" and corresponding similar positional terms as used in the specification, are used and intended in relation to the positioning shown in the drawings, and are not otherwise intended to be restrictive.

What is claimed is:

1. An aerosol valve to dispense product containing powder and/or other solids from an aerosol container, comprising in combination: a valve housing; a valve body having an upstanding valve stem, the valve stem having a central discharge passage and at least one valve orifice extending radially through the stem wall into communication with the central discharge passage; said valve body and stem being moveable axially with respect to the valve housing between closed and open positions; means to bias the valve body toward the closed position; an annular sealing gasket having a central opening defined by a sealing surface surrounding the valve stem in tight-fitting relation and providing the sole seal for the at least one stem valve orifice when the valve body is in the closed position; said valve stem being straight-sided directly above and below the at least one stem valve orifice and characterized by the absence of a gasket-receiving groove encircling the valve stem; the valve body below the valve stem having a plurality of vertical splines spaced about the periphery of the valve body; the plurality of splines having top surfaces abutting and being biased against the underside of the gasket when the valve is in the closed position; a plurality of circumferential spaces extending between said splines and downwardly from the tops of said splines a substantial distance; the top surfaces of the splines having minimal areas in relation to the areas of the circumferential spaces between the tops of the splines; the minimal areas of the spline top surfaces being sufficient to prevent spline penetration through the gasket when the valve is closed, and being insufficient to allow build-up thereon of product solids to interfere with gasket sealing of the at least one stem valve orifice when the valve is closed; and, the diameter of the valve body between adjacent pairs of splines, at and for a substantial distance below the level of the tops of said splines, being no greater than the diameter of the valve stem between the tops of said splines and the at least one stem valve orifice, to avoid the presence of lateral surfaces for product solids build-up interfering with said gasket sealing.

2. The invention of claim 1, wherein said splines adjacent their top surfaces have opposite sides diverging outwardly and downwardly from the top surfaces of said splines.

3. The invention of claim 1, wherein said gasket sealing surface surrounding the valve stem has a lubricant baked thereon.

4. The invention of claim 3, wherein the lubricant is silicone.

5. The invention of claim 1, wherein the at least one stem valve orifice is positioned vertically over the circumferential space between a pair of adjacent splines.

* * * * *